US006108984A

United States Patent [19]

Davidson

[11] Patent Number: 6,108,984

[45] Date of Patent: Aug. 29, 2000

[54] STRUCTURAL CONNECTION SYSTEM FOR USE IN A GEODESIC DOME

[76] Inventor: Robert W. Davidson, 2816 42nd Ave. North, St. Petersburg, Fla. 33714

[21] Appl. No.: 09/273,680

[22] Filed: Mar. 22, 1999

[51] Int. Cl.[7] ..... E04B 7/08

[52] U.S. Cl. ..... 52/81.1; 52/81.2; 52/81.3; 403/171; 403/174; 403/176

[58] Field of Search ..... 52/81.1, 81.2, 52/81.3, 81.4; 403/171, 174, 176, 169, 217, 273, 315, 316

[56] References Cited

U.S. PATENT DOCUMENTS

| | | |
|---|---|---|
| 3,018,858 | 1/1962 | Finlayson . |
| 3,137,371 | 6/1964 | Nye . |
| 3,359,694 | 12/1967 | Hein . |
| 3,710,806 | 1/1973 | Kelly et al. . |
| 4,009,543 | 3/1977 | Smrt . |
| 4,187,613 | 2/1980 | Ivers et al. . |
| 4,542,759 | 9/1985 | Kyner, Jr. et al. . |
| 4,569,165 | 2/1986 | Baker et al. . |
| 4,703,594 | 11/1987 | Reber . |
| 4,729,197 | 3/1988 | Miller . |
| 4,998,552 | 3/1991 | Niksic et al. . |

*Primary Examiner*—Carl D. Friedman
*Assistant Examiner*—Kevin McDermott
*Attorney, Agent, or Firm*—Larson & Larson, P.A.; James E. Larson

[57] ABSTRACT

A plurality of struts are coupled together by a plurality of connection systems for creating a geodesic dome skeletal structure. Each connection system includes a single first connection member including a center body portion having a plurality of cylindrical fingers extending therefrom and a plurality of second connection members. The number of second connection members employed at a specific connection point is proportional to the number of fingers on the first connection member. Each second connection member includes a tubular housing having an inner semi-circular portion mounted along an inner circumference for mating with an outwardly extending semi-circular portion of each cylindrical finger. The mated semi-circular portions form an interface for frictionally locking the tubular strut to the connection system between the first and second connection members.

20 Claims, 4 Drawing Sheets

STRUCTURAL CONNECTION SYSTEM FOR USE IN A GEODESIC DOME

BACKGROUND OF THE INVENTION

1. Field of the Invention

This invention relates to geodesic domes. More particularly, it relates to a structural connection system for use in creating a free standing geodesic dome.

2. Description of Prior Art

Geodesic domes are known in the prior art. They were first developed in response to a need for quick assembled, free standing, low cost building structures. The first geodesic dome was developed by the American inventor, R. Buckminster Fuller in the late 1940's. Geodesic domes are constructed of many straight structural elements, or struts, in tension, arranged in an interlocking framework of triangles whereby the resulting structure, or dome, exhibits reduced stress and weight characteristics. A dome structure constructed in such a manner obviates the need for internal load bearing members, as the skeletal framework defining the dome shape is self-supporting.

Adjoining struts of the geodesic dome are attached to form triangular portions for creating the dome skeletal structure. At any given connection point, six 60 degree angles are created. Many means for attachment of the strut members have been employed. Some domes use hinged members for connection of two adjoining struts, as seen in U.S. Pat. No. 3,018,858 to Finlayson. The use of hinged members for connecting struts to one another is useful for creating a dome structure capable of collapsing upon itself, but is inefficient for creating a dome structure which can be quickly assembled from its disassembled state.

Other means of strut connection are known, such as those of a more rigid nature requiring anchor screws and finishing strips which act in tandem to bolt the connector to the strut member, as seen in U.S. Pat. No. 3,137,371 to Nye. Although this rigid connector forms a strong connection point between adjoining struts, it is labor intensive to employ and requires multiple items (the anchor screws and finishing strips) for attaching the connector to the strut. Further, this type of rigid connection specifically teaches the construction of wood structures. The connectors of Nye would not be suitable for use with other types of known building materials.

In an effort to facilitate quicker assembly of dome structures, certain improvements were made to the connection means. In particular, U.S. Pat. No. 4,009,543 to Smrt discloses a geodesic dome which utilizes v-shaped connectors for coupling two struts of a single triangular section of the dome together. Thereafter six adjacent triangular portions of the dome are joined by bolting the six v-shaped connectors together by bolts through apertures formed in depending flanges of the connectors. Again, although this type of connector ensures a strong connection point between adjoining struts and is certainly less labor intensive than that shown in previous advancements, as discussed hereinabove, the Smrt connector is still labor intensive and requires a multiplicity of parts to affix any given number of adjoining struts.

Still even further attempts at facilitating the quick assembly of dome structures through the use of improved connectors can be seen in U.S. Pat. No. 4,187,613 to Ivers et al. The connector, or gusset, shown therein centers around a common design that requires varying forms to assemble the dome. Ivers et al. lacks a universal connector useable throughout the dome structure thereby raising manufacturing costs and adding to the time of installation of the dome due to the requirement of employing the proper connector at a given connection point.

There is a need for an improved geodesic structure which overcomes the inadequacies and disadvantages seen in the prior art. In particular, the improved dome structure should be quick to assemble and employ minimal structural elements. The elements of the improved dome structure should be easy and inexpensive to fabricate, yet retain the light weight, high load bearing characteristics necessary for a strong geodesic dome structure. The improved dome structure should employ a universal connector element to facilitate easy assembly and keep manufacturing costs to a minimum. The universal connector element should also permit flexibility in the strut members during assembly of any two opposing struts.

SUMMARY OF THE INVENTION

I have invented an improved geodesic dome structure which overcomes the many inadequacies seen in the prior art. My dome structure employs a plurality of single length strut members affixed to one another by a universal connection system. The universality of the structural elements employed in the present invention provides for quick assembly of the dome structure as well as low fabrication costs and reduced labor requirements.

The structural elements of my improved dome structure are fabricated from high strength polymer materials, such as, for example, polyvinyl chloride, polyethylene and polypropylene. The connection system employs universally formed first and second members wherein the first member resembles a six pointed star and the second member is a plurality separate collar units. The first member has six outwardly extending fingers for receiving the end portions of six separate struts. A single collar acts to lock a single strut to a single finger of the first member of the connection system. A pair of semi-circles, one located on each of the first and second members of the connection system mate when the collar is locked into place, ensuring a strong connection point at each finger of each first member of the connection system. The outwardly extending semi-circle of each first member finger permits the attached strut to flex substantially prior to lock down, thereby providing easy installation. The connectors and struts can be hollow permitting electrical and plumbing lines to be fed therethrough.

The size of the dome structure desired dictates the number of struts and connectors to employ. Upon completing the skeletal structure of the dome, a covering can be employed therearound.

My dome allows for a relatively unskilled person to produce a low cost, highly efficient, durable housing structure. The dome design produces the largest interior space per square foot for any given structure. In addition, the shape of the dome provides maximum safety in environments prone to high winds and/or earthquakes.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
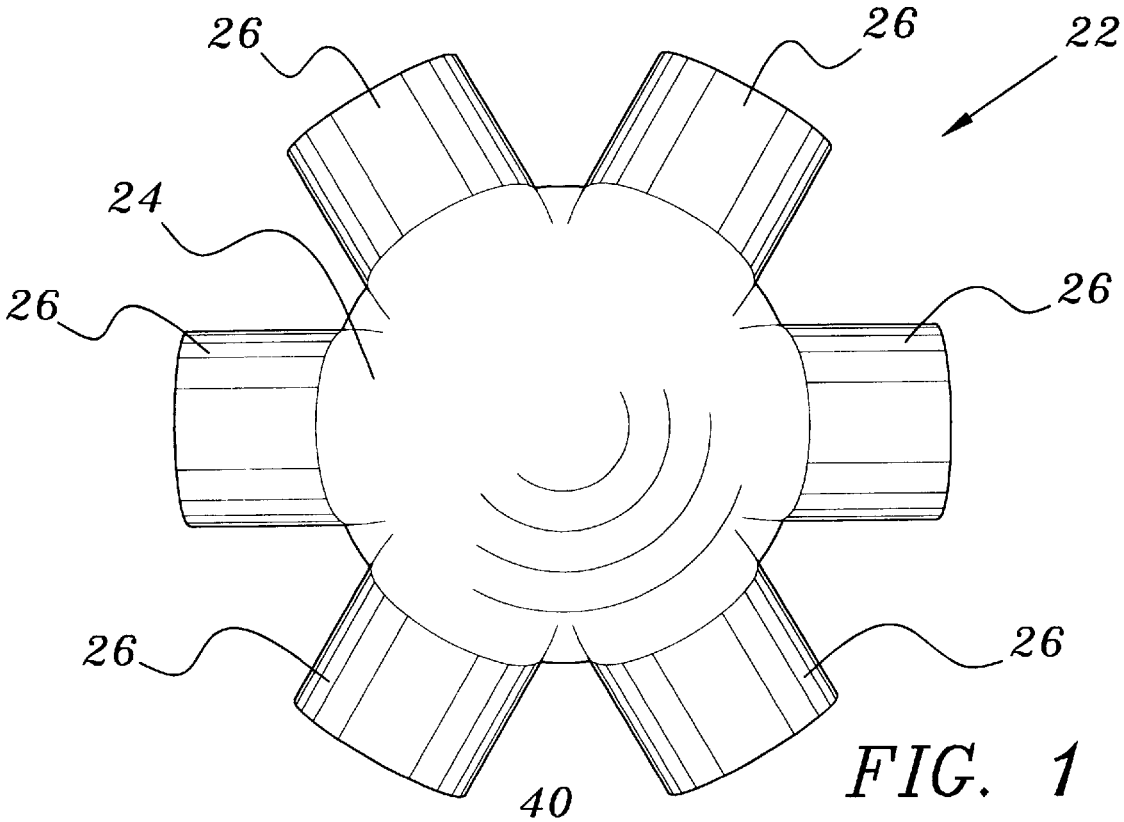
FIG. 1 is a top plan view of a first member of a structural connection system of the present invention for use in creating a geodesic dome.

Throughout the following detailed description, the same reference numerals refer to the same elements in all figures.

Figure 8:
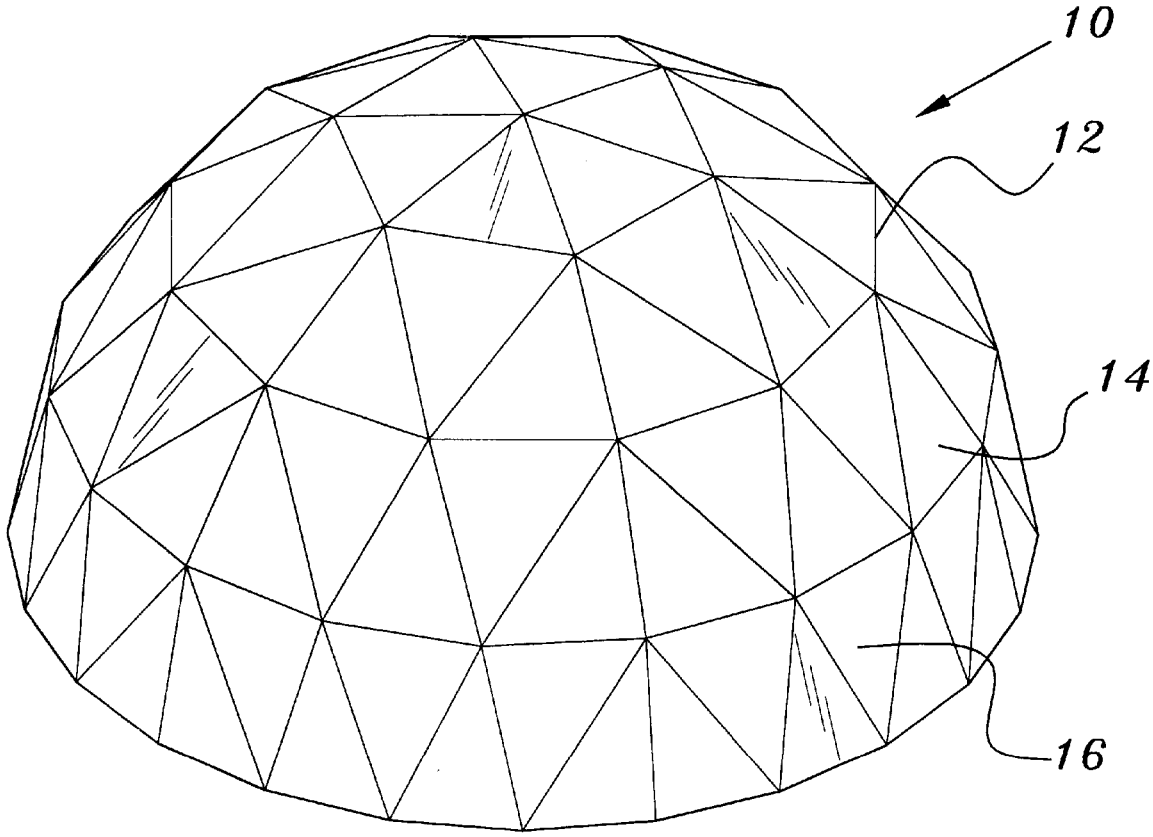
FIG. 8 is a perspective view of a geodesic dome constructed in accordance with the structural connection system of the present invention.

Referring to FIG. 8, a geodesic dome 10 is shown constructed in accordance with the teachings of the present invention. It is understood that FIG. 8 shows a completely constructed dome 10 having its skeletal structure 12 completely assembled and a covering 14 laid thereupon (covering 14 to be discussed in further detail hereinafter). Geodesic dome 10, when assembled, comprises a plurality of triangular portions 16 forming a plurality of hexagons.

Figure 9:
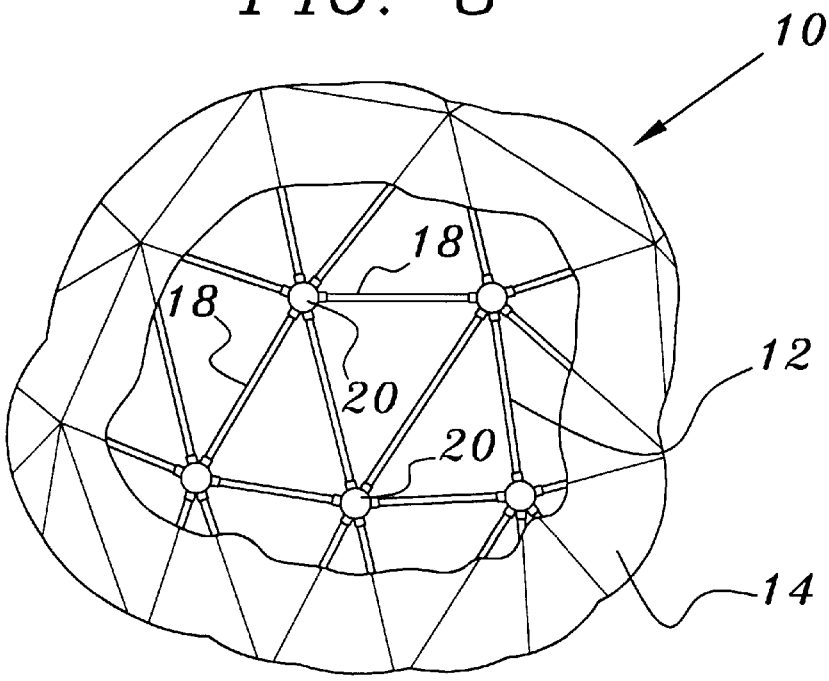
FIG. 9 is a partial view of FIG. 8, partially in section, illustrating how the structural connection system of the present invention secures a plurality of strut members together to form a skeletal structure of the geodesic dome.

Referring to FIG. 9, a partial view of FIG. 8 is shown, partially in section, illustrating how skeletal structure 12 is assembled. It can be seen that skeletal structure 12 is formed by attaching a plurality of strut members 18 to one another by a plurality of connection systems 20 including first and second members. In the preferred embodiment, struts 18 are constructed from predetermined lengths of 1 and ½" or 2" PVC pipes.

Figure 2:
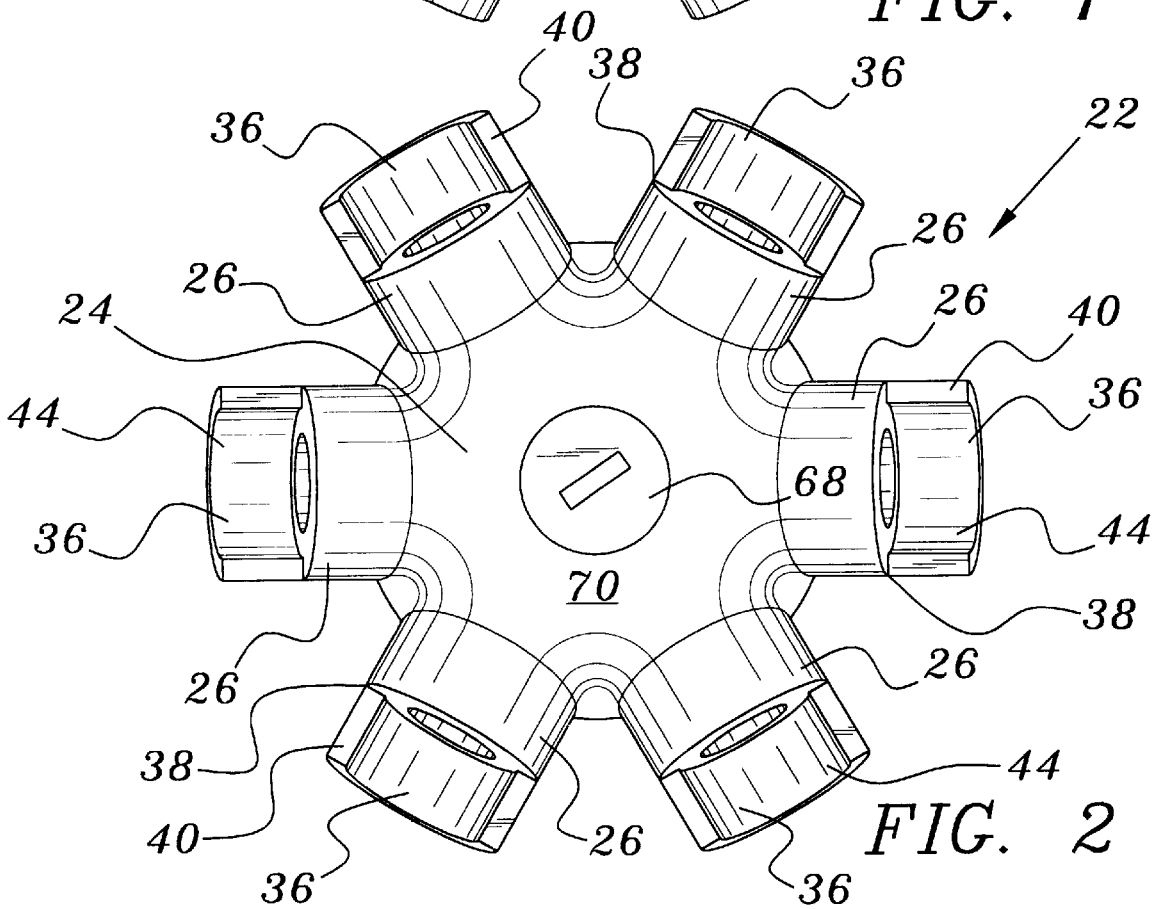
FIG. 2 is a bottom plane view of the first member of FIG. 1.
Figure 3:
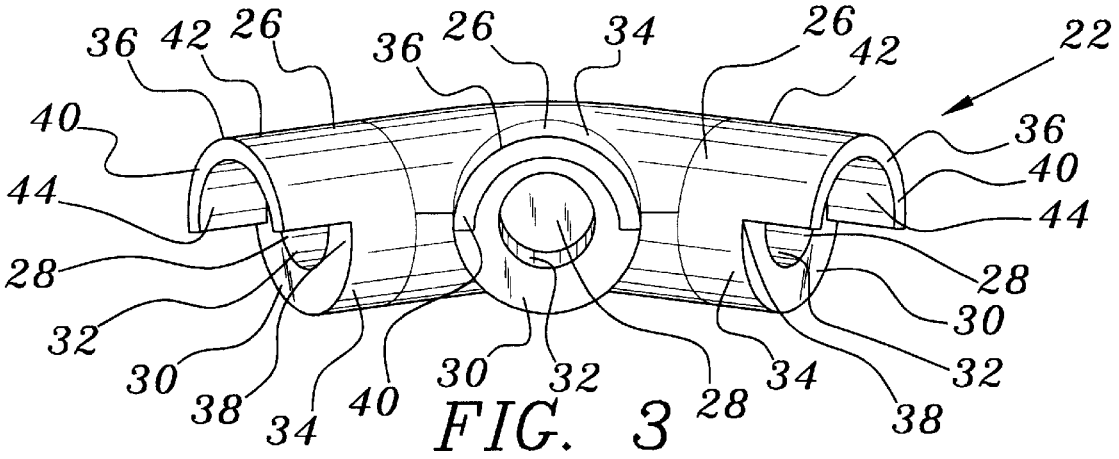
FIG. 3 is a side elevational view of the first member of FIGS. 1 and 2.

Referring to FIGS. 1 and 2, a first member 22 of connection system 20 is shown. First member 22 includes a substantially circular center body portion 24 having six outwardly extending tubular fingers 26 positioned at 60 degree angles from one another. Referring to FIG. 3, each finger 26 has an aperture 28 formed therethrough defining a thickness 30 positioned between an inner and outer circumference, 32 and 34, respectively, of each finger 26. With reference to FIGS. 2 and 3, each finger 26 includes an outwardly extending first semi-circular portion 36 integrally attached along finger 26 at a first end 38 such that a partial outer circumference 42 of first semi-circular portion 36 is continuously formed with finger outer circumference 34. First semi-circular portion 36 has a thickness 40 which is less than equal to finger thickness 30 and is defined by outer circumference 42 and a partial inner circumference 44 of first semi-circular portion 36. In the preferred embodiment, first semi-circular portion 36 represents a half circle or 180 degrees.

Figure 4:
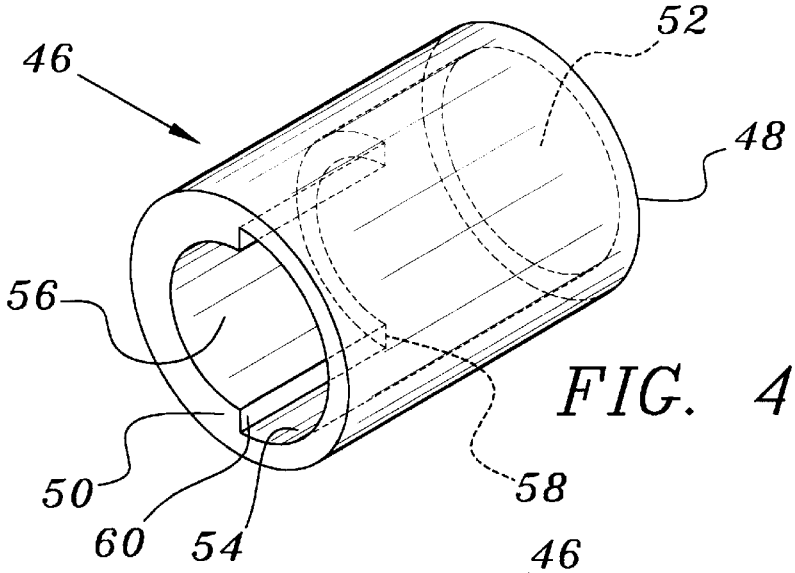
FIG. 4 is a perspective view of a second member of the structural connection system of the present invention.
Figure 5:
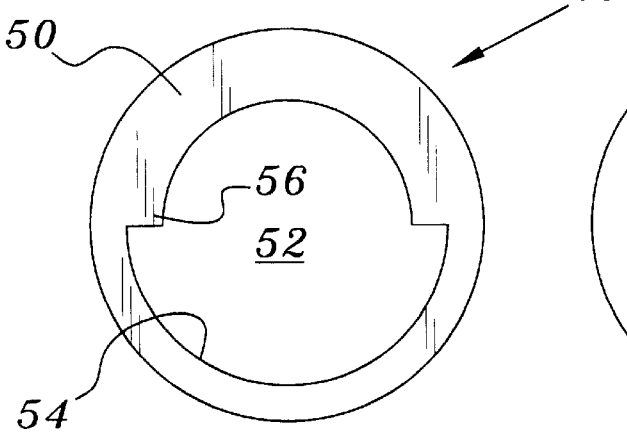
FIG. 5 is a back side view of the second member of FIG. 4.
Figure 6:
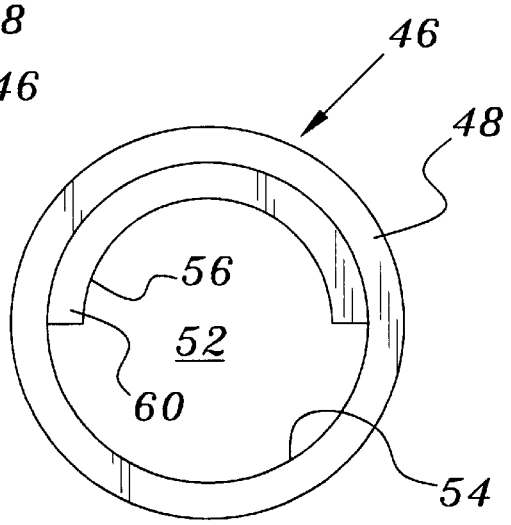
FIG. 6 is a front side view of the second member of FIG. 4.

With reference now to FIG. 4, a second member 46 of connection system 20 is shown. Second member 46 is tubular shaped and has first and second ends, 48 and 50 respectively, and a circular channel 52 formed therethrough. Channel 52 defines an inner circumference 54 having a second semi-circular portion 56 disposed therealong from second end 50 to about a mid portion 58 of second member 46. Second semi-circular portion 56 has a thickness 60 equal to thickness 40 of first semi-circular portion 36.

Figure 7:
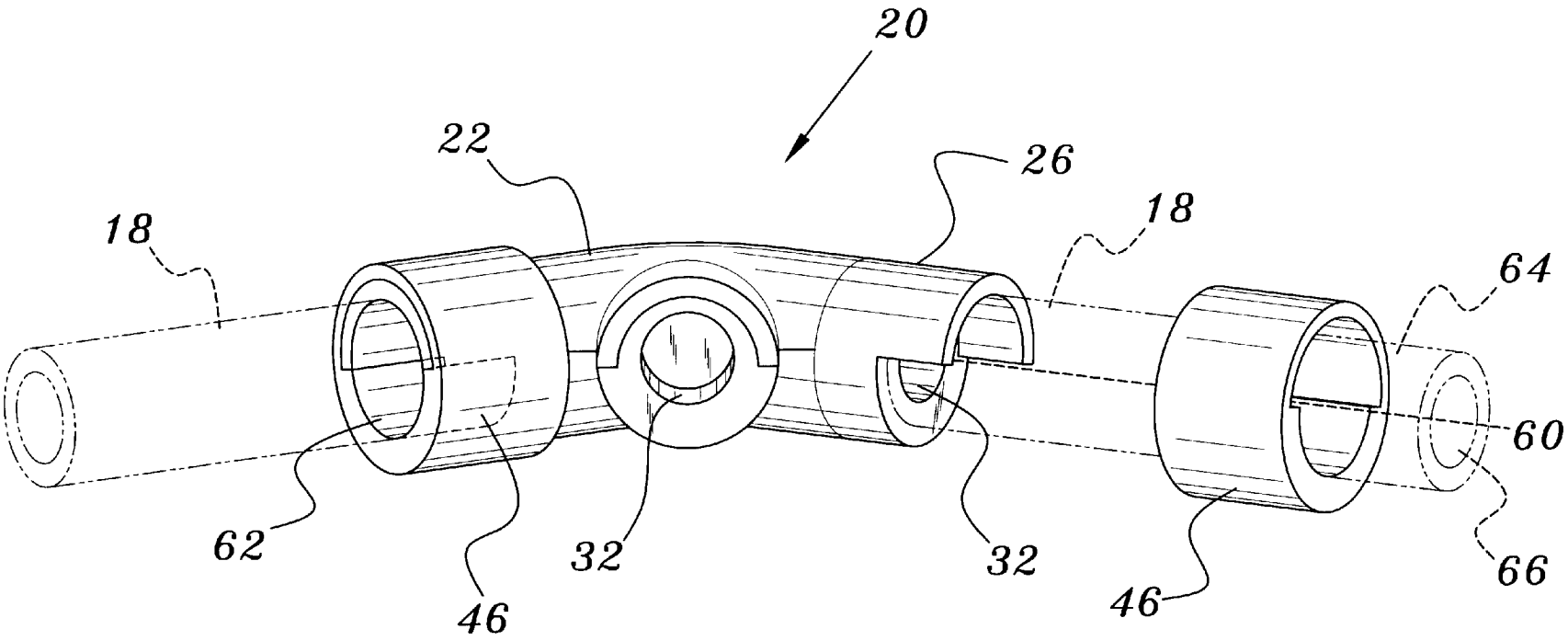
FIG. 7 is a side elevational view of the first and second members of the present invention illustrating how the first and second members secure a strut member to the structural connection system.

Referring to FIG. 7, connection system 20 is shown including first and second members 22 and 46 respectively. Second member 46 acts as a collar to lock strut 18 in place. In particular, a center axis 60 of strut 18 is axially aligned with a center axis (not shown) of a given finger 26 of connection system first member 22. Second member 46 (the collar) is inserted over strut 18 and locks down upon finger 26, with a friction fit, such that first and second semi-circular members, 36 and 56 respectively, mate to form an interface 62. If desired, a glue can be used to permanently bond second member 46 to finger 26. Interface 62 has an inner circumference substantially equal to an outer circumference 64 of strut 18. Further, strut 18 has an inner circumference 66 substantially equal to finger inner circumference 32.

A major disadvantage seen in the prior art is eliminated in the present invention through the use of the two mating semi-circles 36 and 56, respectively. When using a material with little flexibility in a short span, for example PVC, difficulties arise when attaching connectors at opposed ends of a strut. In particular, once a connector is attached at one end of a strut and is employed in the skeletal framework of the dome structure, it is difficult to attach the opposing end of the strut into the appropriate connector due to the rigid nature of the material. In the present invention, the un-mated semi-circular portions 36 and 56 permit flexibility to remain in the skeletal framework prior to locking down the collar (second member 46) over finger 26. Once all of the connection systems 20 are employed at the opposing ends of each strut 18, the plurality of collars (second members 46) are locked down thereby forming a rigid dome structure.

Referring to FIG. 2, a threaded cap 68 is shown covering a corresponding threaded aperture (not shown) formed through a bottom side 70 of first member center body portion 24 at about a center point. A cavity (not shown) located within center body portion 24 permits access to all of the channels, or conduits, formed through struts 18 and fingers 26. Electrical and/or plumbing lines can be fed therethrough for providing electricity and/or plumbing to the dome structure. Further, the threaded aperture can be used as a means for affixing electrical fixtures.

Referring to FIGS. 8 and 9, it is shown that a covering 14 can be employed around skeletal structure 12 comprising the plurality of struts 18 and connection systems 20. Skeletal structure 12 is "woven" from the ground level, growing upwards to form the dome shape. In the preferred embodiment, a hardware cloth, such as a ½" metal mesh, is rolled over skeletal structure 12 and secured with wire ties. Burlap, or other like material, soaked in thinned portland cement is then layered over the hardware cloth and allowed to harden. Concrete is then blown onto the harden skin. Of course alternate means of applying the concrete can be practiced, such as hand application. Use of concrete provides an ideal outer surface which is impervious to termite, water and wildfire damage. Other materials can be employed for covering 14, such as fabric (i.e., a temporary tent structure) or blown fiberglass (similar to techniques used in boat hull construction). Removable insulated paneling can be affixed to the inner spaces of dome 10, providing a finished and environmentally controllable interior, as well as facilitating access to any of the plumbing and/or electrical lines inserted through the conduits in the skeletal structure. Acoustical consideration could also be applied on the inner surface of dome 10, if so desired.

It is understood that dome 10 need not be a structure made specifically for inhabiting. In fact, dome 10 can be used as a simple playground structure or as a storage facility.

Equivalent elements and/or components can be substituted for the ones set forth above such that they perform the same function in the same way for achieving the same result.

Having thus described the invention what is claimed and desired to be secured by Letters Patent is:

1. A universal connection system for coupling an elongated tubular member to a connection point comprising:

a) a first connection member having at least one cylindrical finger and an outwardly extending semi-circular portion, the at least one cylindrical finger having a first end and a center channel formed therethrough defining an inner circumference, the outwardly extending semi-circular portion located at the at least one cylindrical finger first end, an outer surface of the first end perpendicular to an axis of the center channel, b) a second connection member comprising a tubular housing having a first and second end, an inner circumference, a center axis and an inner semi-circular portion mounted to the inner circumference along the center axis proximal to the second end, c) the second connection member positioned around the elongated tubular member, the second connection member first end engaging the first connection member at least one cylindrical finger such that the outwardly extending semi-circular portion of the first connection member mates with the inner semi-circular portion of the second connection member tubular housing forming an interface of the universal connection system, and d) the universal connection system interface having an inner circumference substantially equal to an outer circumference of the elongated tubular member thereby providing frictional engagement of the elongated tubular member between the first and second connection members.

2. The universal connection system of claim 1, wherein the elongated tubular member has a channel formed therethrough defining an inner circumference substantially equal to the first connection member at least one cylindrical finger inner circumference.

3. The universal connection system of claim 1, wherein the elongated tubular member has opposing ends, each end having an outer surface perpendicular to a center axis of the elongated tubular member, the outer surface of one of the opposing ends abutting the first connection member at least one cylindrical finger first end outer surface.

4. The connection system of claim 1, wherein the first connection member at least one cylindrical finger further includes an outer circumference, the outwardly extending semi-circular portion having a partial outer circumference continuously formed with the at least one cylindrical finger outer circumference.

5. The connection system of claim 1, wherein the first connection member has a plurality of cylindrical fingers.

6. The connection system of claim 5, wherein the first connection member further includes a center body portion from which the plurality of cylindrical fingers extend.

7. The connection system of claim 6, wherein the plurality of cylindrical fingers are spaced at equal angles from one another.

8. The connection system of claim 7, wherein six cylindrical fingers are employed.

9. The connection system of claim 8, wherein a plurality of first and second connection members are employed for coupling a plurality of elongated tubular members forming a geodesic dome skeletal structure.

10. A universal connection system for coupling an elongated tubular member to a connection point, the tubular member having a center channel formed therethrough, an inner circumference of the center channel, opposing ends and a center axis, each end having an outer surface perpendicular to the center axis, the universal connection system comprising:

a) a first connection member having at least one cylindrical finger and an outwardly extending semi-circular portion, the at least one cylindrical finger having a first end and a center channel formed therethrough defining an inner circumference, the outwardly extending semi-circular portion located at the at least one cylindrical finger first end, an outer surface of the first end perpendicular to an axis of the center channel, b) a second connection member comprising a tubular housing having a first and second end, an inner circumference, a center axis and an inner semi-circular portion mounted to the inner circumference along the center axis proximal to the second end, c) the second connection member positioned around the elongated tubular member, the outer surface of one of the elongated tubular members opposing ends abutting the first connection member at least one cylindrical finger first end outer surface such that the tubular member center channel is axially aligned with the first connection member at least one cylindrical finger center channel, the second connection member first end engaging the first connection member at least one cylindrical finger such that the outwardly extending semi-circular portion of the first connection member mates with the inner semi-circular portion of the second connection member tubular housing forming an interface of the universal connection system, d) the universal connection system interface having an inner circumference substantially equal to an outer circumference of the elongated tubular member thereby providing frictional engagement of the elongated tubular between the first and second connection members, and e) the elongated tubular member inner circumference substantially equal to the first connection member at least one cylindrical finger inner circumference.

11. The connection system of claim 10, wherein the first connection member at least one cylindrical finger further includes an outer circumference, the outwardly extending semi-circular portion having a partial outer circumference continuously formed with the at least one cylindrical finger outer circumference.

12. The connection system of claim 10, wherein the first connection member has a plurality of cylindrical fingers.

13. The connection system of claim 12, wherein the first connection member further includes a center body portion from which the plurality of cylindrical fingers extend.

14. The connection system of claim 13, wherein the center body portion is substantially circular.

15. The connection system of claim 13, wherein the plurality of cylindrical fingers are spaced at equal angles from one another.

16. The connection system of claim 13, wherein six cylindrical fingers are employed.

17. The connection system of claim 16, wherein a plurality of first and second connection members are employed for coupling a plurality of elongated tubular members forming a geodesic dome skeletal structure.

18. A universal connection system for coupling a plurality of tubular struts together for forming a geodesic dome skeletal structure, the universal connection system comprising:

a) a plurality of first and second connection members, b) each first connection member comprising a center body portion and a plurality of cylindrical fingers extending therefrom, each cylindrical finger having a first end, a center channel formed therethrough defining an inner circumference and an outwardly extending semi-circular portion located at the first end, an outer surface of the first end perpendicular to an axis of the center channel, c) each second connection member comprising a tubular housing having a first and second end, an inner circumference, a center axis and an inner semi-circular portion mounted to the inner circumference along the center axis proximal to the second end, d) a single second connection member positioned around a single tubular strut for engaging a single cylindrical finger of a single first connection member from the second connection member second end such that the first connection member outwardly extending semi-circular portion mates with the second connection tubular housing inner semi-circular portion forming an interface of the universal connection system, and e) the universal connection system interface having an inner circumference substantially equal to an outer circumference of the single tubular strut thereby providing frictional engagement of the strut between the first connection member cylindrical finger and the single second connection member.

19. The universal connection system of claim 18, further comprising the center body portion having a cavity formed therewithin, a threaded aperture formed in a bottom side of the center body portion at a generally center point and a threaded cap for engaging the threaded aperture.

20. The universal connection system of claim 18, wherein polyvinyl chloride is employed for the plurality of tubular struts and plurality of first and second connection members.

* * * * *